United States Patent [19]

Olegnowicz

[11] 4,029,261

[45] June 14, 1977

[54] PISTON DISPLACEMENT LIQUID SPRAY PUMPS

[76] Inventor: Jaime Olegnowicz, Aguilar y Seijas No. 50-502, Mexico, D.F., Mexico, 10

[22] Filed: Apr. 30, 1976

[21] Appl. No.: 681,919

[52] U.S. Cl. ..... 239/333; 222/321; 222/385; 239/350

[51] Int. Cl.[2] ..... B05B 11/02

[58] Field of Search ..... 239/333, 350; 222/341, 222/383, 384, 385, 321

[56] References Cited

UNITED STATES PATENTS 3,248,022 4/1966 Schulman et al. ..... 239/333 X

FOREIGN PATENTS OR APPLICATIONS 1,486,392 5/1967 France ..... 239/333

*Primary Examiner*—Evon C. Blunk
*Assistant Examiner*—Michael Mar
*Attorney, Agent, or Firm*—Imirie, Smiley & Linn

[57] ABSTRACT

A piston displacement liquid spray pump comprises a container; a supporting ferrule engaged on the neck of the container, a hollow cylindrical housing supported by the ferrule, and having at least one slit at its upper end to permit air communication between the container and the atmosphere; a stem within the housing; a hollow stem extension telescopically engaged outwardly of the upper section of the stem; an actuator engaging the upper end of the stem extension and capable of biasing it and the stem downwardly; a check valve comprising a seat at the lower end of the housing, a valve chamber above the seat and a bullet-shaped hollow floating valve member; a longitudinal groove along the upper section of the stem and communicating with the hollow extension; a piston slidably movable within said housing and mounted on the lower end of the hollow stem extension with a lost motion engagement to enable the piston to obstruct the groove during its upward stroke and to uncover same during its downward stroke; the piston when the stem is at its uppermost position, being capable of locking the slit to prevent leakage from the container; and spring to bias the stem and the extension upwardly.

6 Claims, 7 Drawing Figures

PISTON DISPLACEMENT LIQUID SPRAY PUMPS

BACKGROUND OF THE INVENTION

The present invention refers to spray pumps and, more particularly, it is related to spray pumps of the lost motion displacement piston type, useful for spraying liquids from containers therefor.

It is well known that pressurized spray containers have lost certain popularity because the health authorities of different countries have ascertained that the gaseous propellants used to spray the liquid contained therein, have the disadvantageous property of being air pollutants which affect the ozone content of the atmosphere, whereby their use has been restricted and presumably should be prevented as much as possible. Said health authorities have been encouraging, therefore, the use of other types of spraying devices, particularly those which do not use any gaseous high pressure propellant, whereby the research and development activities of many companies in the world have been focused towards the development of this type of devices.

The different types of piston displacement pumps extant in the market and built in accordance with the prior art, however, suffer of a number of drawbacks, particularly in connection with the possibility of leakage of the liquid from the container when at rest and alos in view of the inefficiency of some check valves used in said devices, as well as the costly diaphragms which are generally provided to prevent leakage from the interior of the container when the pump is being actuated.

On the other hand, the means provided in many of the prior art piston type pumps for venting the container in order to prevent the creation of a vacuum as the liquid is being dispensed therefrom, generally comprise pinholes at suitable places, in order to permit the entrance of air from the atmosphere into the container, whereby this type of containers generally produce considerable leakage when carelessly left standing on their sides or upside down when not in use. On the other hand, the prior art piston displacement spray pumps are generally provided with a piston having a lost motion mounting on the stem of the pump in order to alternately obstruct and clear the exit conduit on each cycle, for producing mist and the like. This conduit, however, has been generally built interiorly of the stem, such as by providing an axial bore in the said stem, which is generally a one-piece member, whereby the problems of molding and constructing said stem having the very thin bore necessary to permit the flow of the liquid outwardly of the device, have been generally very complex and have left much to desire as regards the economy of production and the efficiency of the pumping action of this type of devices. Also, the check valves provided at the inner end of the pumping chamber or cylinder, have been generally valves which merely consist of a thickened end of the stem itself, which, when pressed, plugs a bore communicating the pumping chamber with a flexible pipe introduced in the liquid, or merely consist of a ball-type check valve, both of which are somewhat inefficient and tend to cause some pumping problems.

OBJECTS OF THE INVENTION

Having in mind the defects of the prior art lost motion pumping displacement type pumps for spraying liquids, it is an object of the invention to provide a piston displacement pump for spraying liquids which is highly efficient in its performance and yet of very low cost to be manufactured.

It is another object of the present invention to provide a liquid spray piston displacement pump of the above character, which will effect a highly efficient pumping and spraying action and yet will not be subject to leakage of the liquid contained within the container associated therewith, regardless of the position of the latter when at rest.

It is still a further object of the present invention to provide a liquid spray piston displacement pump of the above mentioned character, which will permit to effectively and cheaply build the pumping stem and piston assembly through very simple and economical molding operations.

Still another object of the present invention is to provide a liquid spray piston displacement pump of the above identified character, which will permit to effectively and efficiently provide for the continuous unobstructed feed of liquid into the pumping chamber, at the same time providing turbulence in the liquid for a more effective spraying.

It is still another object of the present invention to provide a liquid spray piston displacement pump of the above character, which will provide for an effective venting of both the pumping cylinder and the container associated therewith, as well as the effective sealing thereof to prevent leakage of liquid in any position of the container when at rest.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of a specific embodiment when read in connection with the accompanying drawings, in which:

DETAILED DESCRIPTION

Figure 1:
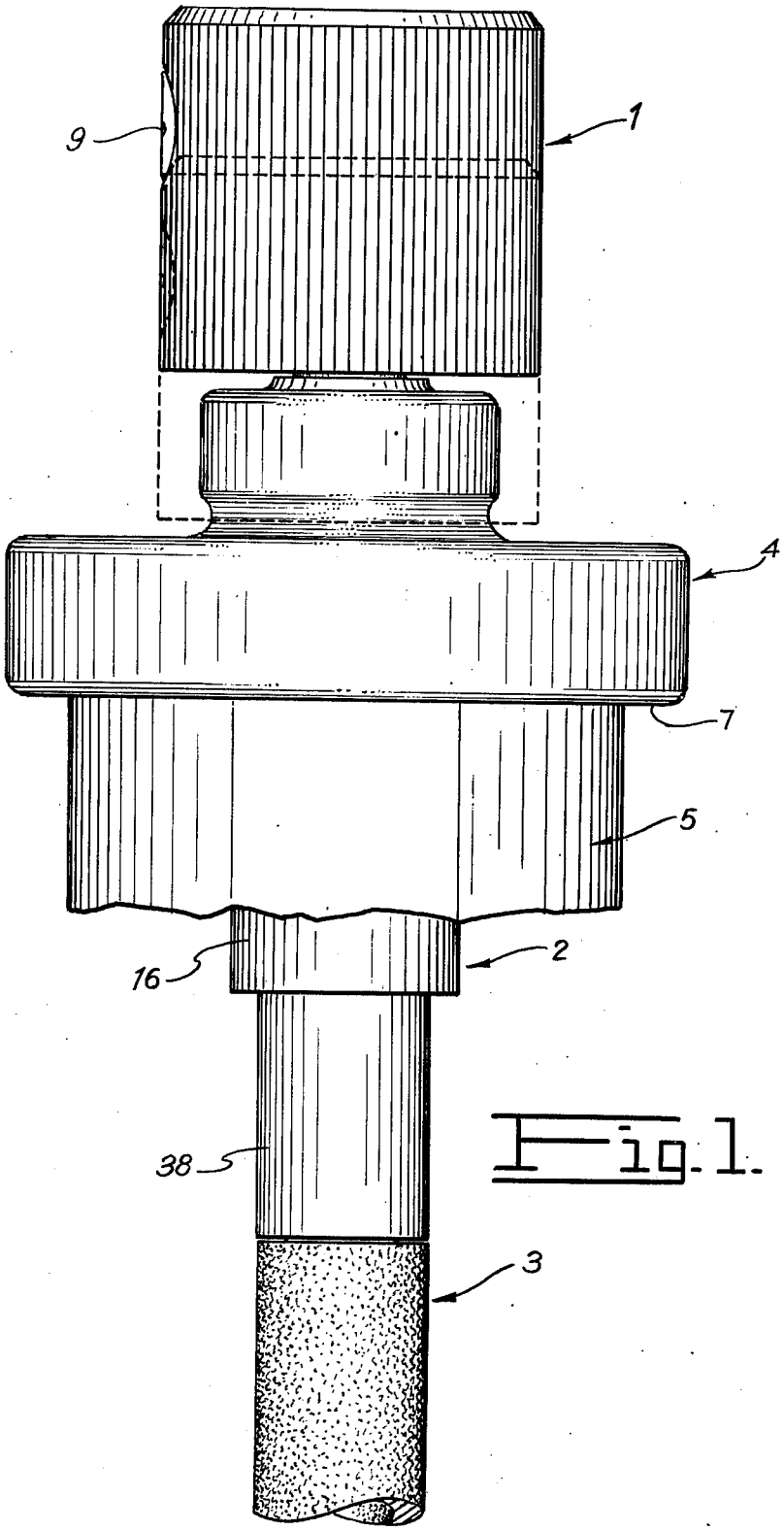
FIG. 1 is a fragmentary elevational view of the liquid spray pump built in accordance with the present invention, showing the device at its rest position and also showing the actuator in its pressed position by means of dotted lines.

Having now more particular reference to the drawings and more specifically to FIG. 1 thereof, it can be seen that the piston displacement liquid spray pump built in accordance with a preferred embodiment of the present invention comprises as its main parts an actuator 1 having an exit nozzle 9 to produce a mist of a liquid contained in the container 5 associated therewith; a housing 2 formed of an upper or pumping section 16 and a lower or check valve section 38 provided with a connecting lowermost section 46 (FIG. 3) designed to be engaged to a flexible pipe 3, only shown in a fragmentary view throughout the drawings, with said flexible pipe 3 being introduced in the body of liquid to be pumped; a ferrule 4 engaged to the neck of a container by any suitable means, such as by the crimp section 7 thereof crimped around the lip 6 of the container; all of the assembly being associated with said container 5 (only shown at its neck section for the sake of clarity in the drawings) wherein the liquid to be pumped is introduced prior to crimping the said ferrule 4 on the neck of container 5, around lip 6 thereof.

Turning now to the cross-sectional elevational views of any of FIGS. 2, 3, 4 and 5, it can be seen that the actuator 1 of the pump in accordance with a preferred embodiment of the present invention is formed of an upper solid section 8 wherein a horizontal or radial very thin bore (not shown) is provided to discharge the liquid pumped to the outlet nozzle 9 as is conventional in this type of devices, and wherein a vertical or axial wider bore is also provided at 10, in direct communication with the thin bore and of a diameter suitable to receive therein the upper end 25 of the stem extension 24 that will be more fully described hereinbelow. The lower section of the actuator 1 is hollow and provides a lower cylindrical chamber to enable said actuator 1 to clear the upper cylindrical projection 12 of the ferrule 4 when said actuator 1 is pressed down to effect a pumping stroke as will be more fully described below.

Figure 2:
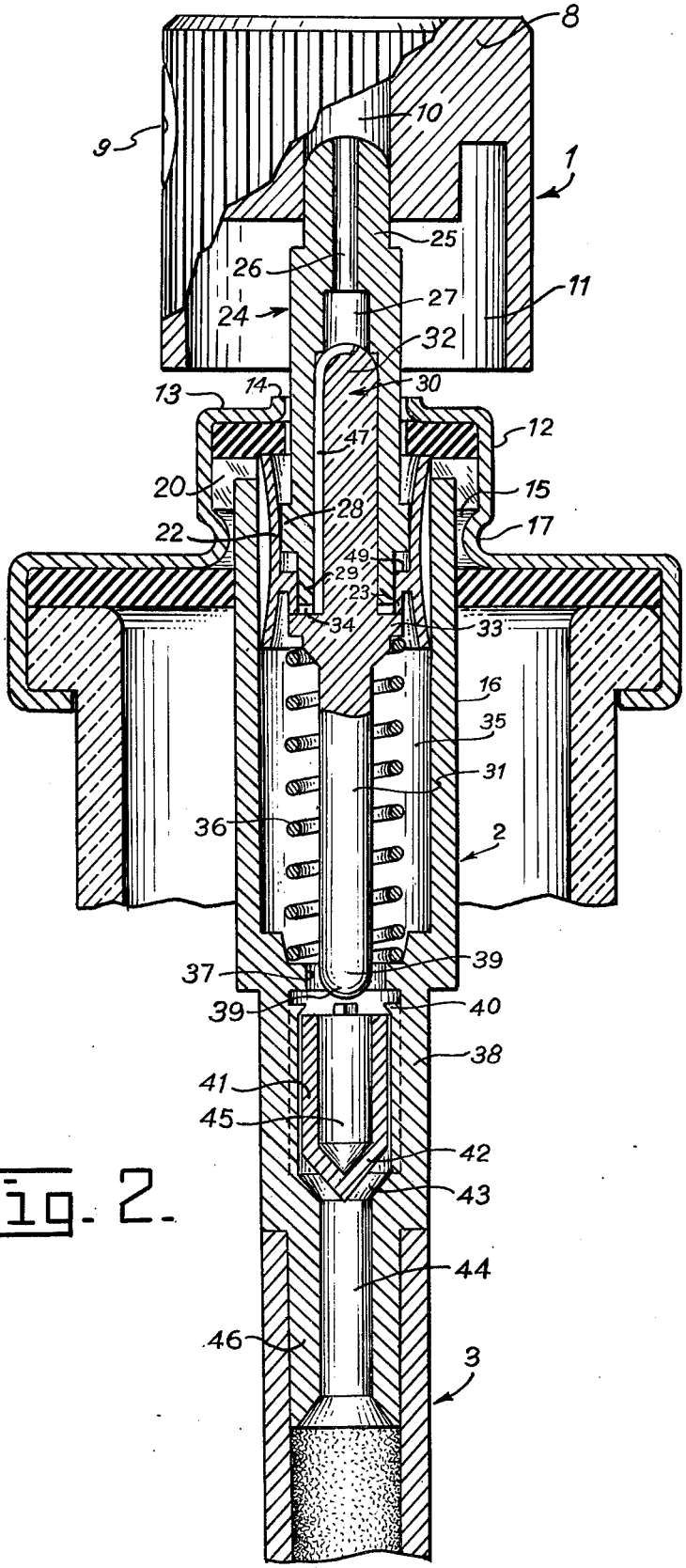
FIG. 2 is a fragmentary cross sectional elevational view of the liquid spray pump in accordance with the present invention, when at its rest position.

The ferrule of the pump built in accordance with the present invention comprises a generally metallic member comprising a crimp section 7 as described above, which is crimped around the lip 6 of container 5; a cover section 19 between which and the lip 6 is pressed a flexible packing 18 shaped as an annular disk, in order to prevent leakage of the liquid contained in container 5 through crimp 7; a central reduced diameter upwardly directed projection 12 around which actuator 1 is pressed down to effect the pumping stroke, said central projection 12 being provided with a circular depression 17 at its lowermost section, to support above the same the lip 15 of housing 2 of the pump as clearly shown in FIG. 2 of the drawings. The central projection 12 is also provided with a cover section 13 at which center is provided an open mouth or lip 14 through which the stem extension 24 passes to effect its alternate motion as will be described hereinbelow. The lip 15 of housing 2 is provided with a slit 20 preferably on two diametrically opposed points of its circumference in order to provide communication between the upper or venting section 48 of the pumping section 16 and the air space of container 5 through the central opening of packing 18 for a purpose that will be described below. An annular packing washer 21 is firmly pressed between the cover section 13 of projection 12 and the lip 15 of housing 2 in order to prevent fluid communication between chamber 48 and container 5 other than through the slits 20, the central opening of washer 21 being loosely arranged around the outer surface of stem extension 24 to permit air communication between the chamber 48 and the atmosphere for venting said chamber and the container.

Figure 4:
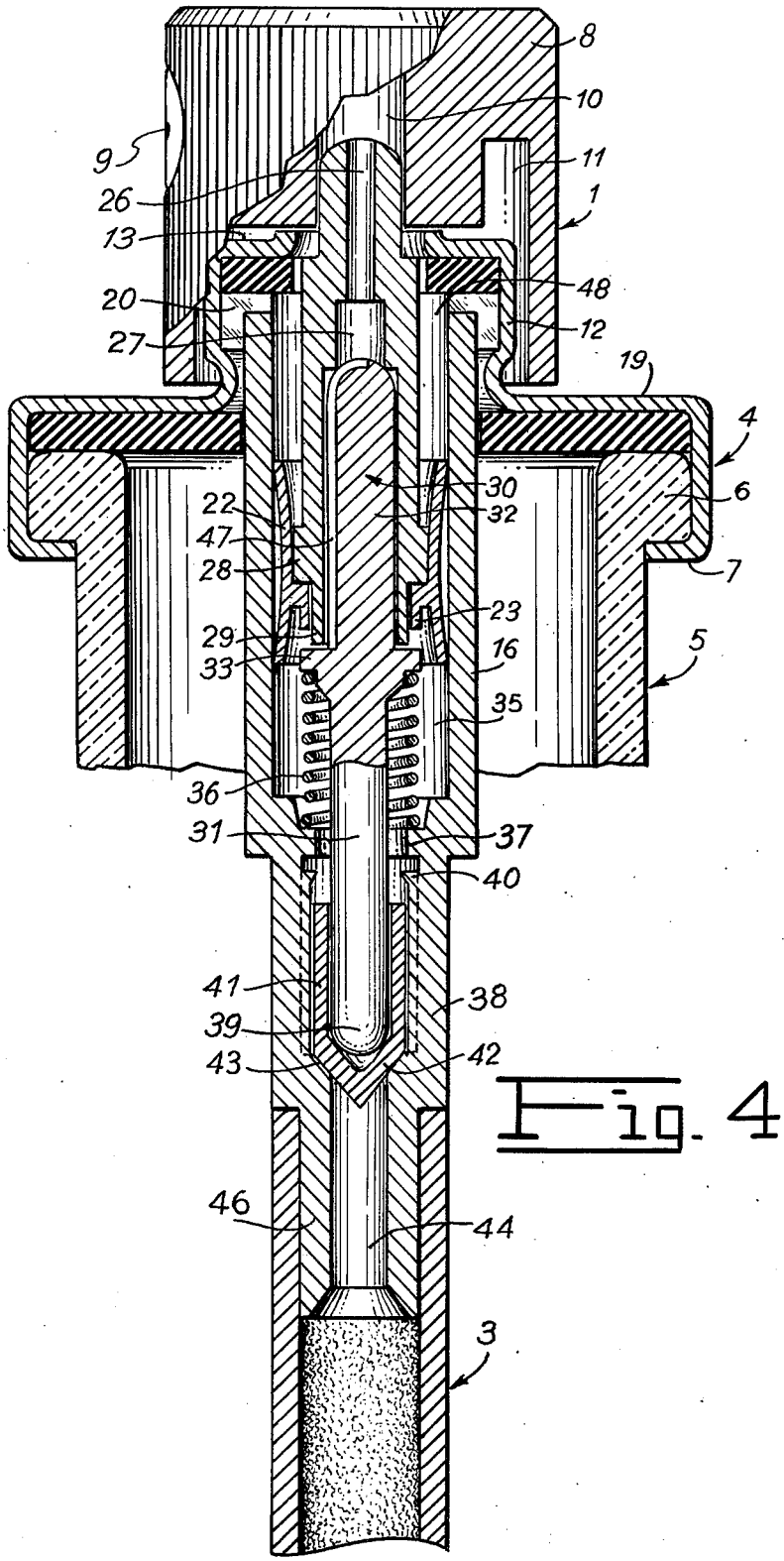
FIG. 4 is a view similar to FIG. 3, showing the actuator, the stem and the piston of the pumping device fully pressed and at the end of said pumping stroke.

Within the pumping section 16 of housing 2 a piston 22 is arranged to slidably move therealong between an uppermost position as shown in FIG. 2 and a lowermost position as shown in FIG. 4. The piston 22 is preferably shaped as a concave cylindrical member so as to provide a snug fit at its two ends with the inner surface of the wall of said pumping section 16 so as to fully prevent any undue passage of liquid from the pumping chamber 35 to the venting chamber 48 both when the piston 22 is actuated or when the said piston is at rest. The piston 22 is provided with an inwardly directed circular protrusion 49 having a cylindrical flange 23 at its inner end, said flange 23 being mounted with a snug fit around the lower cylindrical section 29 of the stem extension 24.

The stem extension 24 of the pumping device built in accordance with the present invention is formed as a hollow member having an upper reduced diameter section 25 provided with an axial bore 26 in direct communication with bore 10 of actuator 1 as described above; in intermediate cylindrical section 27 provided with a bore comprising a continuation of bore 26 of a larger diameter and provided with a shoulder to limit the inward telescopic insertion of the stem; an enlarged section 28 forming a stop for the upper edge of the piston protrusion 49 along said lower cylindrical section 29 around which the flange 23 of the piston 22 is mounted, said lower section 29 being of a length larger than the corresponding length of the flange 23 of said protrusion 49 for a purpose that will be fully understood by having reference to the description below.

Figure 3:
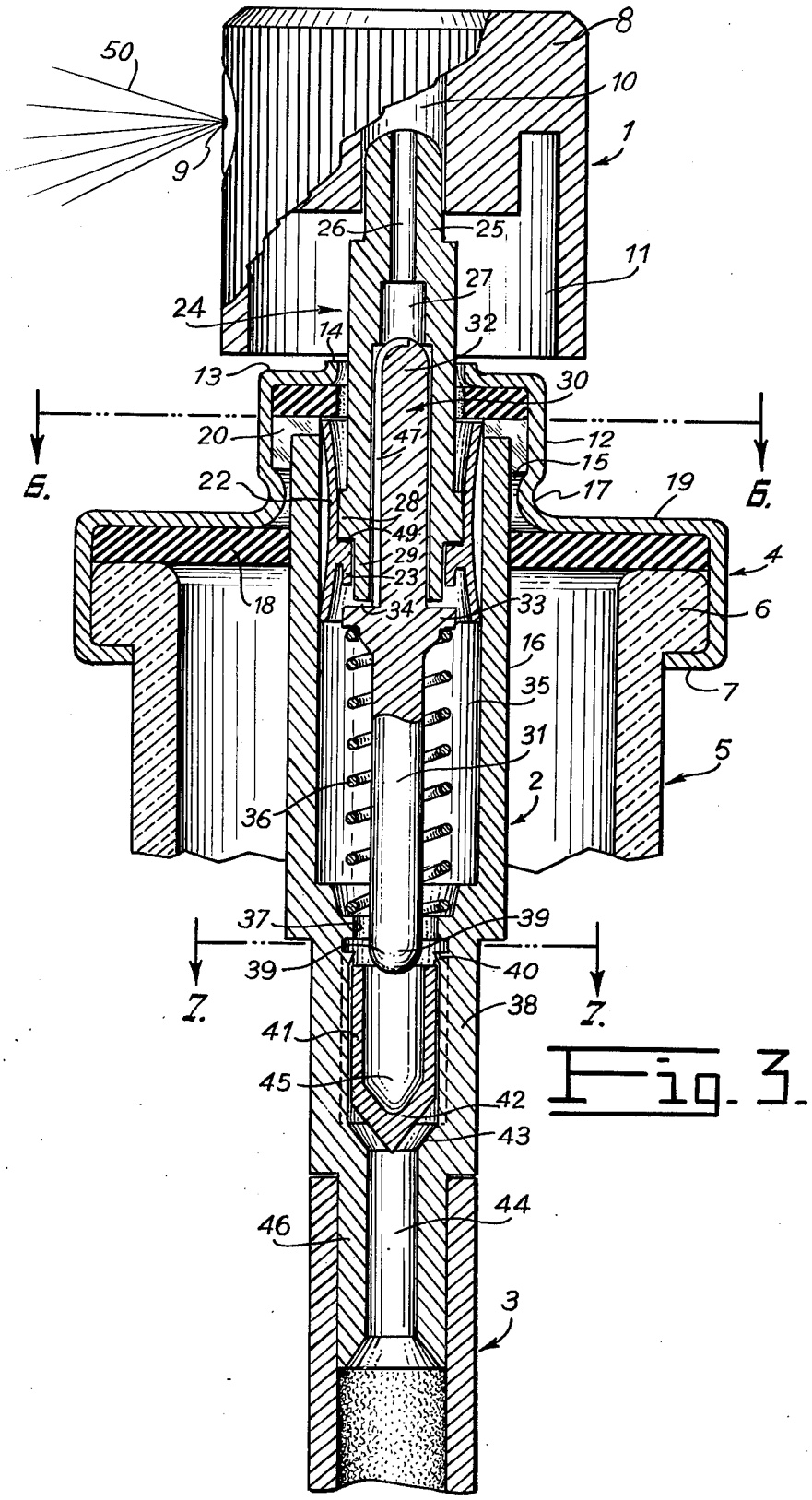
FIG. 3 is a view similar to FIG. 2, showing the actuator and stem in a position when the pumping stroke begins.

The stem 30 comprises a solid cylindrical member of an outer diameter suitable to permit its telescopic insertion into the bore of the stem extension 24 as clearly shown in any one of FIGS. 2 through 5. Said stem is formed with an upper member 32 and a lower member 31 integrally molded with an enlarged section or flange 33 therebetween. The upper annular flat surface of said flange 33, when the stem is fully introduced into the bore of the stem extension 24, leaves a span 34 between the same and the lower edge of cylindrical section 29 of the stem extension, and the upper member 32 of stem 30 is provided with a longitudinal groove 47 (also shown in cross section in FIG. 6) which spans the whole length of said upper member 32, whereby the bore 26 of stem extension 24 is in direct communication with the pumping chamber 35 through span 34 between flange 33 of stem 30 and the cylindrical section 29 of stem extension 24 when the piston protrusion 49 is abutting against th stop 28 of said stem extension as shown in FIGS. 3 and 4 of the drawings. The stem 30 is actuated through the stem extension 24 by means of actuator 1 throughout its downward or pumping stroke, and a helical spring 36 is arranged with its upper end biasing flange 33 of the stem 30 and its lower end bearing on a flange 37 provided at the lower end of the pumping section 16 of housing 2, in order to actuate the stem in its upward or charging stroke when the actuator 1 is released. The piston 22, by virtue of it being mounted on the cylindrical section 29 of the stem extension 24 with a lost motion engagement in view of the fact that the length of the flange 23 of its protrusion 49 is shorter than that of section 29, remains stationary until the flange 33 engages the same to bias it upwardly.

The check valve section 38 is a hollow cylindrical section provided below flange 37 of the pumping section 16 and its cylindrical bore is provided with a beveled lower end or seat 43 in direct communication with the reduced diameter bore 44 of the connecting section 46 around which the flexible feed pipe 3 is arranged. A bullet-shaped valve member 41 is arranged within the bore of the check valve section 38, said valve member 41 having a lower conical end 42 which cooperates with the beveled seat 43 to fully obstruct the passage 44 during the pumping stroke of the stem 30, the upward movement of said valve member 41 being restricted by means of a plurality of stops 40 inwardly extending of the upper end of the bore of the check valve section just below flange 37. The valve member 41 is hollow and its bore 45 opens upwardly to receive therewithin the end 39 of the lower stem member 31 when the same is pushed down by the actuator.

The operation of the device of the present invention is clearly depicted in the sequence formed by FIGS. 2, 3, 4 and 5 of the drawings and a full cycle thereof will be described hereinbelow.

When the spray pump of the present invention is in its closed position shown in FIG. 2 of the drawings, the piston is being biased upwardly by means of the spring 36 through the interaction of flange 33 of stem 30 whereby the cylindrical flange 23 of protrusion 49 of the piston 22 will be firmly abutting against the upper surface of flange 33, fully obstructing any communication between the pumping chamber 35 and the groove 47, which prevents any possible leakage of liquid through groove 47 and bore 26 of the stem extension 24 outwardly of the nozzle 9 of actuator 1. Also, the upper edge of piston 22 will be pressed against the lower surface of the packing washer 21, whereby any possible leakage of the liquid contained in container 5 through the central opening of the annular packing 18, slits 20 of lip 15 of housing 2 and central opening of the packing washer 21 is fully prevented regardless of the position of the container 5.

In the position illustrated in FIG. 2, the valve member 41 of the check valve 38 is floating in the liquid and the pumping chamber is filled up with the liquid fed through flexible pipe 3.

At the beginning of the pumping stroke illustrated in FIG. 3 of the drawings, that is, when the actuator 1 is pushed down with a finger, the stem extension 24 is slightly introduced with the piston 22 remaining stationary until the lower edge of shoulder 28 abuts the upper edge of protrusion 49, whereby the span 34 between flange 33 and section 29 is cleared by the cylindrical flange 23 of protrusion 49 and the pumping chamber 35 is directly communicated with nozzle 9 through span 34, groove 47 and bore 26. Further pressing of actuator 1 will produce the movement of piston 22 along the pumping section 16 whereby the liquid contained in pumping chamber 35 will push the valve member 41 against its seat 43 and therefore the liquid will be forced outwardly of the nozzle 9 in the form of, for example, a mist 50. At the same time, the upper edge of piston 22 will be disengaged from the packing washer 21 whereby the container 5 will be vented to the atmosphere through the central opening of annular packing 18, slits 20 of lip 15 of housing 2 and the central opening of the packing washer 21 thus preventing a vacuum to be produced in the container by the liquid extracted during the charging stroke as will be described below.

During the pumping stroke, the lower end 39 of stem 30 is introduced with a certain violence into the bore 45 of valve member 41, whereby a high turbulence is produced within pumping chamber 35, which aids in the production of a very fine mist 50. The pumping stroke continues until the device is in the position shown in FIG. 4 of the drawings with the lower end 39 of the stem 30 fully introduced in the bore 45 of valve member 41.

Figure 5:
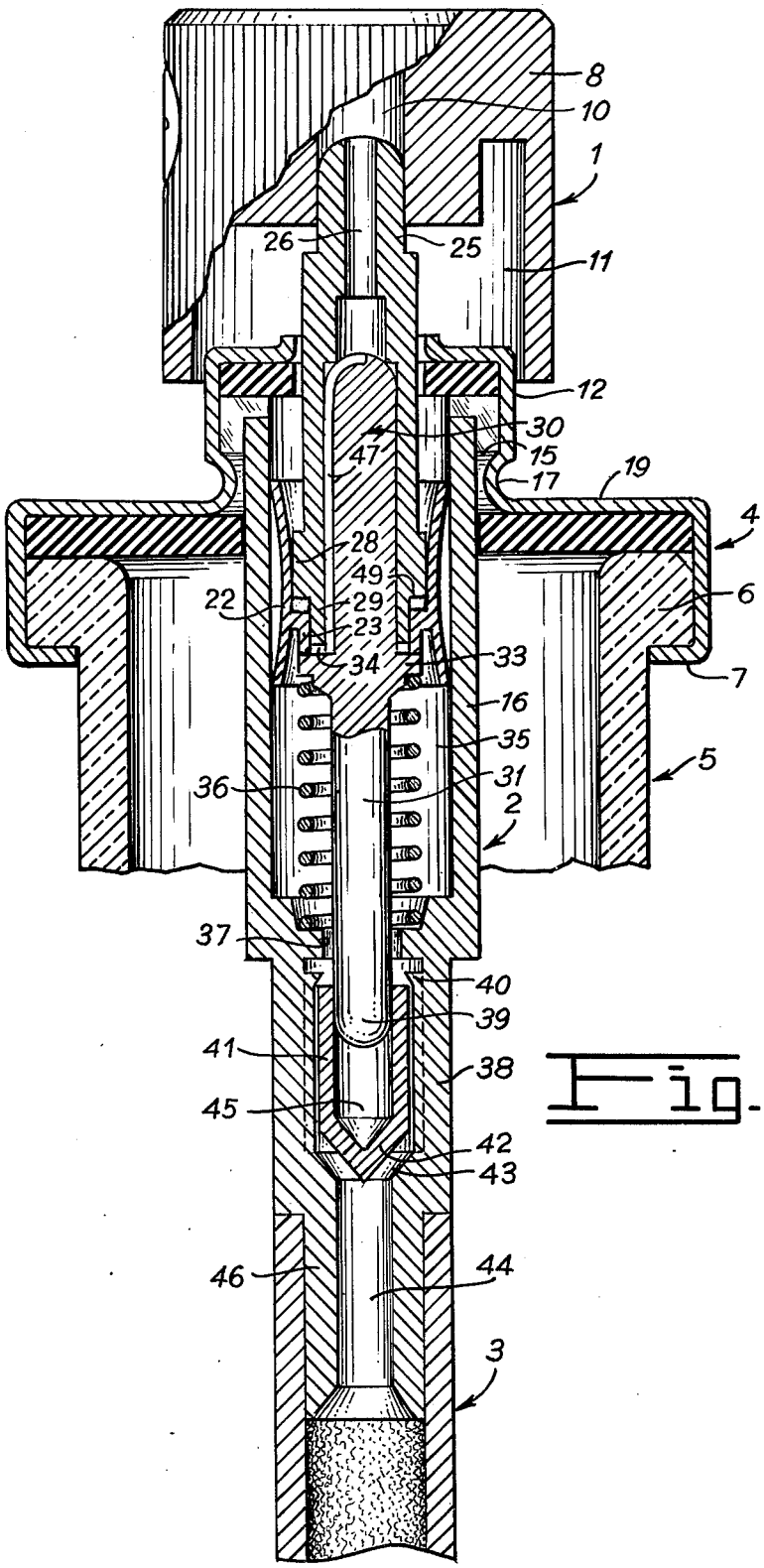
FIG. 5 is a view similar to FIG. 2, showing the device at an intermediate position of its charging stroke.
Figure 6:
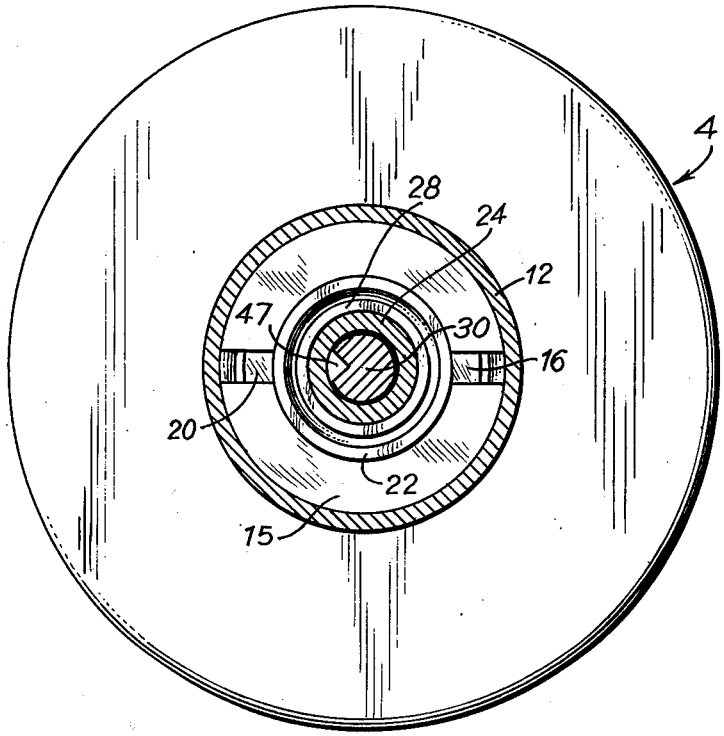
FIG. 6 is a plan cross sectional view taken along lines 6—6 of FIG. 3 and looking in the direction of the arrows.
Figure 7:
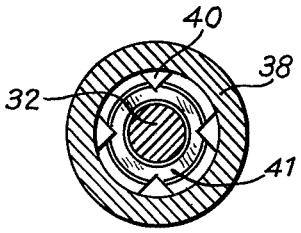
FIG. 7 is a plan cross sectional view taken along lines 7—7 of FIG. 3 and looking in the direction of the arrows.

When the actuator 1 is released, as shown in FIG. 5 of the drawings, the spring 36 biases the stem upwardly for a short distance while the piston 22 remains again stationary due to its lost motion engagement. This again places the flange 33 firmly bearing on the lower end of cylindrical flange 23 of piston 22, whereby the communication between the pumping chamber 35 and groove 47 is fully obstructed whereby air cannot enter into said pumping chamber from the atmosphere through nozzle 9, bore 26, groove 47 and span 34. The relative vacuum created by the ascending motion of piston 22 therefore lifts valve member 41 so that its lower end 42 is removed from seat 43, thus permitting the liquid in the container 5 to flow into the pumping chamber 35 through flexible pipe 3, bore 44 and check valve 38 to produce the charging stroke of the device until the stem reaches the position of FIG. 2, thus completing the cycle. During the charging stroke, as mentioned above, the container 5 is vented to the atmosphere to permit the entrance of air to compensate for the amount of liquid extracted during said charging stroke, thus avoiding the creation of a vacuum.

It will thus be seen that the piston displacement liquid spray pump in accordance with the present invention may be considered as highly advantageous as compared to prior art spray pumps in that the pump of the present invention provides very simple and yet effective means for venting the container to the atmosphere and at the same time prevents any leakage of the container when in the closed position by fully obstructing the venting channels by means of the piston of the device. Also, the provision of a stem formed of two telescopically arranged members, provides for simplicity of construction thereof, inasmuch as the outlet channel may be provided as a mere surface open groove 47 which forms a passage with the outer telescopic stem extension, without the need of troublesome drilling or molding operations to provide a very thin passage as was the case of the prior art integral stems. The provision of a check valve having a hollow bullet-shaped valve member is another definite advantage of the present invention, as said arrangement, besides being much more efficient than prior art check valves, provides for the creation of additional turbulence in the fluid through cooperation with the lower end of the stem, thus aiding in the production of a finer and more uniform mist. The venting chamber of the pumping section, of course, is substantially directly communicated with the atmosphere, whereby the actuator may be operated at a greater speed without the danger of creating backward pressures on the piston as is the case with some diaphragm type devices.

Although certain specific embodiments of the present invention have been shown and described, it is to be pointed out that many modifications thereof are possible. The invention, therefore, is not to be restricted except insofar as is necessitated by the prior art and by the spirit of the appended claims.

What I claim is:

1. A piston displacement liquid spray pump comprising in combination a container; a pump supporting ferrule engaged on the neck of said container; a hollow cylindrical housing having an upper end provided with an outwardly extending lip, the lower edge of said lip being supported on said ferrule and its upper edge pressing a packing washer against the cover portion of said ferrule, at least one outwardly directed radial slit being provided through said lip of the housing whereby venting of the said container is permitted through said at least one slit to the atmosphere; a stem within said housing; a hollow stem extension telescopically engaged outwardly of the upper section of said stem; an actuator engaging the upper end of said stem extension and capable of biasing the same and said stem downwardly, said actuator being provided with an outlet passage and nozzle in communication with the bore of said hollow stem extension; a check valve comprising a valve chamber, a valve seat at the lower end of said valve chamber, and a bullet-shaped hollow floating valve member cooperating with said valve seat and within which the lower end of said stem is received on its downward movement; a longitudinal groove along the upper section of said stem and forming a passage with the complementary bore of said hollow stem extension communicating the interior of said housing with said nozzle; a piston slidably movable within said housing and forming therewith a pumping chamber and a venting chamber, said piston being mounted on the lower end of said hollow stem extension with a longitudinal lost motion engagement thereto; an outwardly directed annular flange on the middle portion of said stem; the lower end of said stem extension being spaced from the upper surface of said annular flange so as to form a span communicating said groove with said pumping chamber; said lost motion engagement of the piston enabling said piston to fully obstruct said span during its upward or charging stroke and to clear the same during its downward or pumping stroke; said piston when the stem is at its uppermost position, being capable of firmly bearing against the lower surface of said packing washer thus blocking said at least one slit to prevent leakage from the container; and spring means to bias said stem and said stem extension upwardly in unison.

2. A spray pump as claimed in claim 1 wherein said piston is a concave cylindrical member with its upper and lower edges firmly bearing against the inner wall of said housing, said concave cylindrical piston having an annular protrusion extending radially inwardly thereof and supporting a cylindrical downwardly directed flange, said stem extension having a stop to push said flange downwardly and said annular flange of said stem being arranged so as to be capable of pushing said cylindrical flange of the piston upwardly, the distance between said stop and said annular flange being larger than the length of said cylindrical flange whereby said lost motion engagement of said piston is provided.

3. A spray pump as claimed in claim 2 wherein the lower end of said check valve is connected to a flexible pipe introduced into the liquid in the container.

4. A spray pump as claimed in claim 3 wherein said bullet-shaped valve member of said check valve is provided with an upwardly open bore, the lower end of said stem being violently introduced within said upwardly open bore during its downward or pumping stroke, whereby a high turbulence is created in said pumping chamber to aid in the production of a finer and more uniform mist through said nozzle.

5. A spray pump as claimed in claim 1 wherein two diametrically opposed slits are provided through said outwardly extending lip of said housing, said lip being firmly pressed between said packing washer and a circular depression extending inwardly of said ferrule, said ferrule being crimped around the lip of the neck of said container pressing an annular packing therebetween, said annular packing having a central opening loosely fitting around said housing, whereby venting of said container to the atmosphere is effected through said loose fit of the central opening of said annular packing, said diametrically opposed slits and thence through the span between said packing washer and said hollow stem extension to the atmosphere.

6. A spray pump as claimed in claim 1 wherein said bullet-shaped valve member is retained within a short distance from said valve seat by means of a plurality of inwardly directed projections located above said valve member.

* * * * *